US009659705B2

(12) United States Patent
Muneuchi et al.

(10) Patent No.: US 9,659,705 B2
(45) Date of Patent: May 23, 2017

(54) METHOD OF PRODUCING SURFACE-MOUNT INDUCTOR

(71) Applicant: TOKO, INC., Tsurugashima-shi (JP)

(72) Inventors: Keita Muneuchi, Shiki (JP); Masaaki Totsuka, Tsurugashima (JP); Chitoshi Sakai, Kawagoe (JP); Kunio Sasamori, Higashimatsuyama (JP)

(73) Assignee: Murata Manufacturing Co., Ltd., Nagaokakyo-Shi (JP)

( * ) Notice: Subject to any disclaimer, the term of this patent is extended or adjusted under 35 U.S.C. 154(b) by 247 days.

(21) Appl. No.: 14/279,032

(22) Filed: May 15, 2014

(65) Prior Publication Data

US 2014/0338185 A1 Nov. 20, 2014

(30) Foreign Application Priority Data

May 17, 2013 (JP) ..... 2013-104668

(51) Int. Cl.

| | |
|---|---|
| ***H01F 41/06*** | (2016.01) |
| ***H01F 41/10*** | (2006.01) |
| ***H01F 17/04*** | (2006.01) |
| ***H01F 41/00*** | (2006.01) |
| ***H01F 41/12*** | (2006.01) |

(Continued)

(52) U.S. Cl.

CPC ..... *H01F 41/005* (2013.01); *H01F 17/04* (2013.01); *H01F 27/292* (2013.01); *H01F 41/06* (2013.01); *H01F 41/063* (2016.01); *H01F 41/066* (2016.01); *H01F 41/076* (2016.01); *H01F 41/10* (2013.01); *H01F 41/127* (2013.01); *H01F 2017/048* (2013.01); *Y10T 29/4902* (2015.01);

(Continued)

(58) Field of Classification Search

CPC ..... H01F 41/005; H01F 41/06; H01F 41/063; H01F 41/066; H01F 41/076; H01F 41/127; H01F 41/10; H01F 17/04; H01F 27/292; H01F 2017/048; Y10T 29/4902; Y10T 29/49071; Y10T 29/49073; Y10T 29/49174

See application file for complete search history.

(56) References Cited

U.S. PATENT DOCUMENTS

| | | | | |
|---|---|---|---|---|
| 6,144,280 | A * | 11/2000 | Amada | H01F 41/10 29/602.1 |
| 6,198,373 | B1 * | 3/2001 | Ogawa | H01F 41/127 336/83 |
| 2009/0250836 | A1 * | 10/2009 | Fukui | H01F 41/005 264/272.15 |

FOREIGN PATENT DOCUMENTS

| | | | |
|---|---|---|---|
| JP | 10-284343 | | 10/1998 |
| JP | 2000331839 | A * | 11/2000 |
| JP | 2005-116708 | | 4/2005 |

* cited by examiner

*Primary Examiner* — A. Dexter Tugbang
(74) *Attorney, Agent, or Firm* — Cozen O'Connor

(57) ABSTRACT

A method of producing a surface-mount inductor including an external electrode having high fixing strength with respect to an element body even in a high-humidity environment. The method includes the steps of: winding an electrically-conductive wire to form a coil; forming a core using a sealant primarily containing a metal magnetic powder and a resin in such a manner as to encapsulate the coil in the sealant while allowing each of opposite ends of the coil to be at least partially exposed on a surface of the core; reducing smoothness of a surface of at least a part of a portion of the core on which an external electrode is formed as compared to a surface therearound; and forming the (Continued)

external electrode on the core in such a manner as to be electrically conducted with the coil.

13 Claims, 9 Drawing Sheets

(51) Int. Cl.
*H01F 41/076* (2016.01)
*H01F 41/063* (2016.01)
*H01F 41/066* (2016.01)
*H01F 27/29* (2006.01)

(52) U.S. Cl.
CPC .... *Y10T 29/49071* (2015.01); *Y10T 29/49073* (2015.01); *Y10T 29/49174* (2015.01)

METHOD OF PRODUCING SURFACE-MOUNT INDUCTOR

TECHNICAL FIELD

The present invention relates to a method of producing a surface-mount inductor and, more particularly, to a method of forming an external electrode of the surface-mount inductor.

BACKGROUND ART

Heretofore, there has been employed a surface-mount inductor in which an external electrode is formed on a chip-like element body by using an electrically-conductive paste. For example, JP 2005-116708A discloses a method which comprises: applying an electrically-conductive paste on a surface of a resin-molded chip encapsulating a winding wire; then curing the electrically-conductive paste to form an underlying electrode; and further subjecting the underlying electrode to plating to form an external electrode.

SUMMARY OF THE INVENTION

Technical Problem

Generally, in the conventional surface-mount inductor, as the electrically-conductive paste, there has been used a type in which metal particles such as Ag are dispersed in a thermosetting resin such as an epoxy resin. In this type of electrically-conductive paste, shrinkage stress arising from curing of the thermosetting resin is utilized to cause the metal particles dispersed in the resin to come contact with each other or with an electrically-conductive wire to thereby obtain electrical conductivity.

Meanwhile, the resign in the electrically-conductive paste tends to be degraded in a high-humidity environment. In the case where the surface-mount inductor as disclosed in JP 2005-116708A is formed using a conventional electrically-conductive paste, there is a problem that a bonding strength between the element body and the external electrode becomes degraded under a moisture resistance test, causing peeling of the external electrode.

As an alternative electrode forming method, there has been known a method which comprises sintering a metal powder contained in an electrically-conductive paste to form an underlying electrode, as disclosed in JP 10-284343A. As the electrically-conductive paste, it is possible to use a type obtained by kneading a metal powder such as an Ag powder, an inorganic binder such as glass frit, and an organic vehicle. This electrically-conductive paste is applied to a chip-like element body, and then sintered by heating at a temperature of 600 to 1000° C. to form the underlying electrode. When this method is used, metal particles of the metal powder are mutually sintered, and baked onto the element body, so that it becomes possible to increase the bonding strength between the element body and the external electrode. However, this method is required to allow an inorganic binder such as glass frit in the electrically-conductive paste to be melted, so that it is necessary to subject the electrically-conductive paste to a heat treatment at a high temperature of 600° C. or more. Thus, for production of a surface-mount inductor configured such that a winding wire formed by winding an electrically-conductive wire is encapsulated therein with a sealant primarily comprising a magnetic powder and a resin, the above method cannot be employed, because, if the sealant and the winding wire are subjected to a heat treatment at a temperature greater than 250° C., the resin in the sealant or a self-bonding coating of the electrically-conductive wire will be degraded.

It is therefore an object of the present invention to provide a method of producing a surface-mount inductor which comprises an external electrode having high fixing strength with respect to an element body even in a high-humidity environment.

Solution to Problem

To accomplish the above object, the method of producing a surface-mount inductor according to the present invention comprises the steps of: winding an electrically-conductive wire to form a coil; forming a core using a sealant primarily containing a metal magnetic powder and a resin in such a manner as to encapsulate the coil in the sealant while allowing each of opposite ends of the coil to be at least partially exposed on a surface of the core; reducing smoothness of a surface of at least a part of a portion of the core on which an external electrode is formed as compared to a surface therearound; and forming the external electrode on the core in such a manner as to be electrically conducted with the coil.

Effect of Invention

The present invention makes it possible to produce a surface-mount inductor which comprises an external electrode having high fixing strength with respect to an element body even in a high-humidity environment.

DESCRIPTION OF EMBODIMENTS

In the method of producing a surface-mount inductor according to the present invention, a surface of at least a part of a portion of the core, for allowing an external electrode to be formed thereon is caused to be increased in roughness as compared to a surface therearound. This makes it possible to allow an electrically-conductive paste to be entered into concave portions on the surface of the core while increasing a contact area between the external electrode and an element body. Further, in the method of producing a surface-mount inductor according to the present invention, an electrically-conductive paste containing metal fine particles having a sintering temperature of 250° C. or less is applied onto the surface of the core. This makes it possible to allow the metal fine particles contained in the electrically-conductive paste to be easily entered into concave portions on the surface of the core while increasing a contact area between the external electrode and the element body. Furthermore, by using an electrically-conductive paste containing metal fine particles having a sintering temperature of 250° C. or less, the metal fine particles are sintered with each other or with an internal electrical conductor at a low temperature, so that the DC resistance is not degraded even in a high-humidity environment.

Embodiments

With reference to the drawings, a surface-mount inductor production method of the present invention will now be described.

Figure 1:
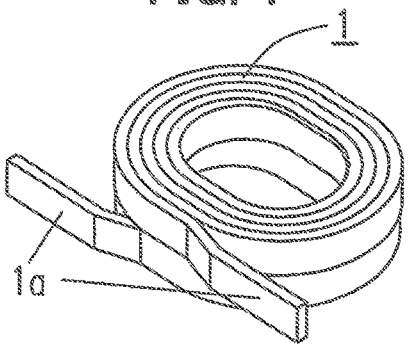
FIG. 1 is a perspective view of an air-cored coil for use in a first embodiment of the present invention.
Figure 2:
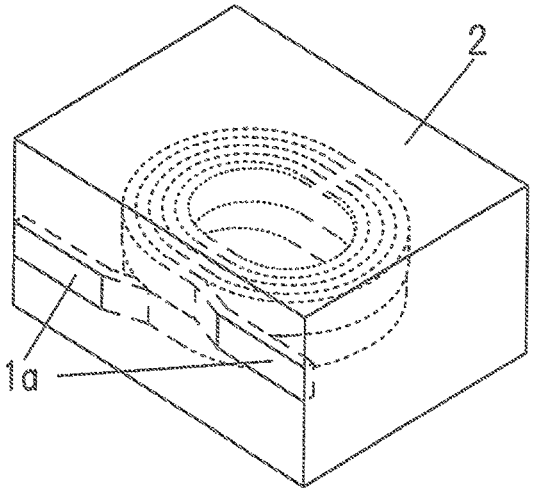
FIG. 2 is a perspective view of a core according to the first embodiment, of the present invention.
Figure 3:
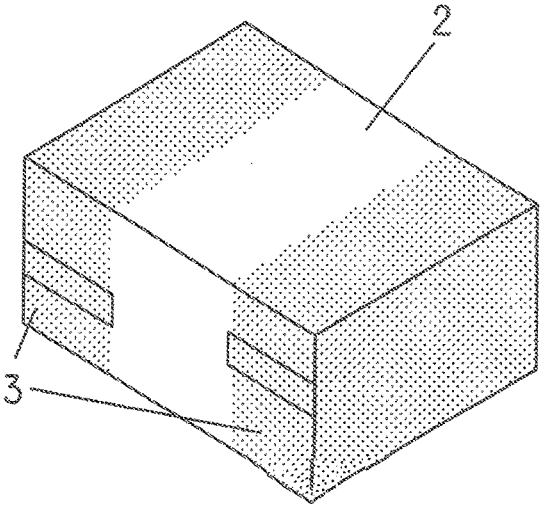
FIG. 3 is a perspective view of the core in a fabricated state according to the first embodiment of the present invention.
Figure 4:
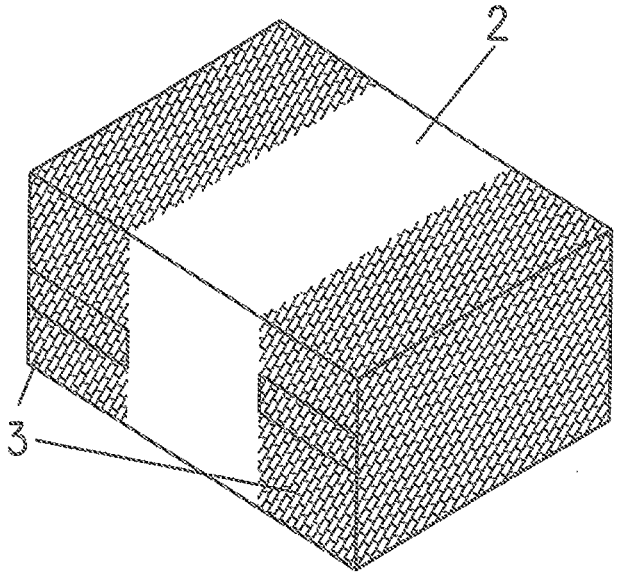
FIG. 4 is a perspective view of the core to which an electrically-conductive paste is applied, according to the first embodiment of the present invention.
Figure 5:
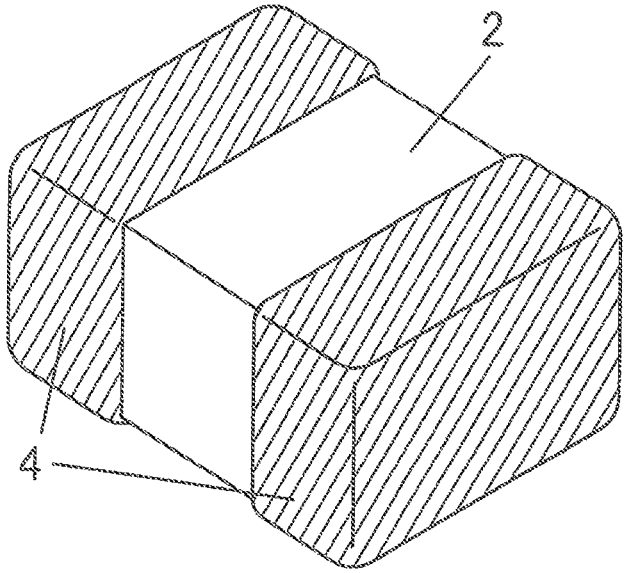
FIG. 5 is a perspective view of a surface-mount inductor produced by a method according to the first embodiment of the present invention.

With reference to FIGS. 1 to 5, a surface-mount inductor production method according to a first embodiment of the present invention will be described. FIG. 1 illustrates a perspective view of an air-cored coil for use in a first embodiment of the present invention. FIG. 2 illustrates a perspective view of a core of a surface-mount inductor according to the first embodiment of the present invention. FIG. 3 illustrates a perspective view of the core in a fabricated state according to the first embodiment of the present invention. FIG. 4 illustrates a perspective view of the core to which an electrically-conductive paste is applied, according to the first embodiment of the present invention. FIG. 5 illustrates a perspective view of a surface-mount inductor produced by a method according to the first embodiment of the present invention.

Firstly, an electrically-conductive wire having a rectangular cross-section provided with a self-bonding coating is used to form a coil. As illustrated in FIG. 1, the electrically-conductive wire is wound in two-tiered outward spiral pattern in such a manner as to allow its opposite ends 1*a* to be positioned on an outermost periphery to form a coil 1. As the electrically-conductive wire for use in this embodiment, a type is used which has an imide-modified polyurethane layer as the self-bonding coating. Alternatively, the self-bonding coating may be of polyamide series or polyester series, preferably having a higher heatproof temperature. Further, the electrically-conductive wire used in this embodiment has a rectangular cross-section. Alternatively, it is also possible to use around wire or a wire having a polygonal cross-section.

Next, as a sealant, a type is used in which iron-based metal magnetic powders and an epoxy resin are mixed and granulated into powders to form a core 2 encapsulating the coil as illustrated in FIG. 2 by a compressing molding process. In this process, each of the opposite ends 1*a* of the coil is allowed to be exposed on a surface of the core 2. In this embodiment, the core is formed by the compressing molding process. Alternatively, it is also possible to form the core by other molding process such as a powder compacting molding process.

Then, after removing the coating on a surface of the exposed opposite ends 1*a* by mechanical stripping, a treatment such as lasering, sandblasting or polishing is applied to the entire portion of the core 2 for allowing an external electrode to be formed thereon to remove components such as a resin component present on its surface to roughen the surface, thereby causing the surface of the entire portion of the core 2, for allowing the external electrode to be formed thereon, to be increased in roughness as compared to a surface therearound, as illustrated in FIG. 3. As a result, the surface of the entire portion of the core 2 for allowing the external electrode to be formed thereon is reduced in smoothness as compared to a surface therearound.

Next, as illustrated in FIG. 4, an electrically-conductive paste 3 is applied by a dip process on the portion of the core 2 for allowing the external electrode to be formed thereon. In this embodiment, as the electrically-conductive paste, a type is used in which metal particles such as Ag are dispersed in a thermosetting resin such as an epoxy resin. Further, the dip process is used in this embodiment as a process for applying the electrically-conductive paste. Alternatively, it is also possible to use other process such as a printing process or a potting process.

The core 2 on which the electrically-conductive paste 3 is applied is subjected to a heat treatment at 200° C., thereby to cause the core 2 and the thermosetting resin in the electrically-conductive paste to be cured. In this way, shrinkage stress arising from curing of the thermosetting resin is utilized to cause the metal particles dispersed in the resin of the electrically-conductive paste to come contact with each other or with an electrically-conductive wire to thereby obtain electrical conductivity. Further, the electrically-conductive paste 3 is fixed to the core 2, with the thermosetting resin and the metal particles in the electrically-conductive paste being entered into the concave portions on the surface of the core, formed in the roughened portion of the surface of the core 2.

Finally, the core 2 is subjected to plating to form an external electrode 4 on the surface of the electrically-conductive paste, thereby to obtain a surface-mount inductor as illustrated in FIG. 5. The electrode formed by the plating may be formed by appropriately selecting one or more from materials such as Ni, Sn, Cu, Au and Pd.

(Second Embodiment)

Figure 6:
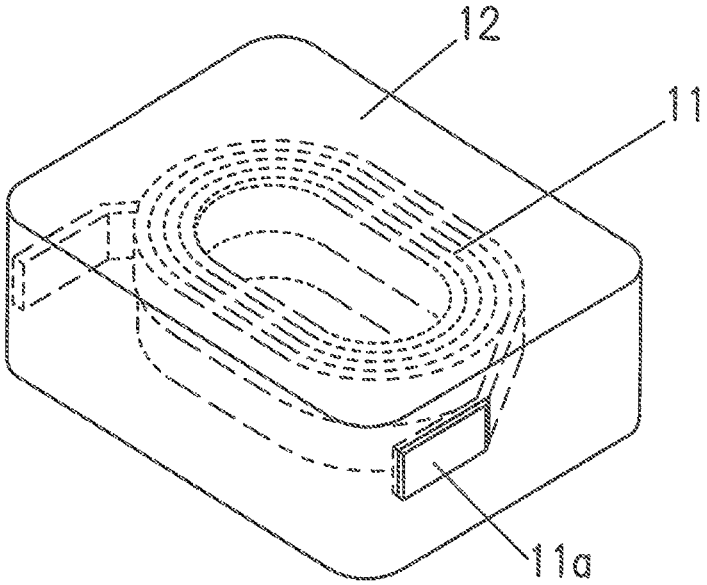
FIG. 6 is a perspective view of a core according to a second embodiment of the present invention.
Figure 7:
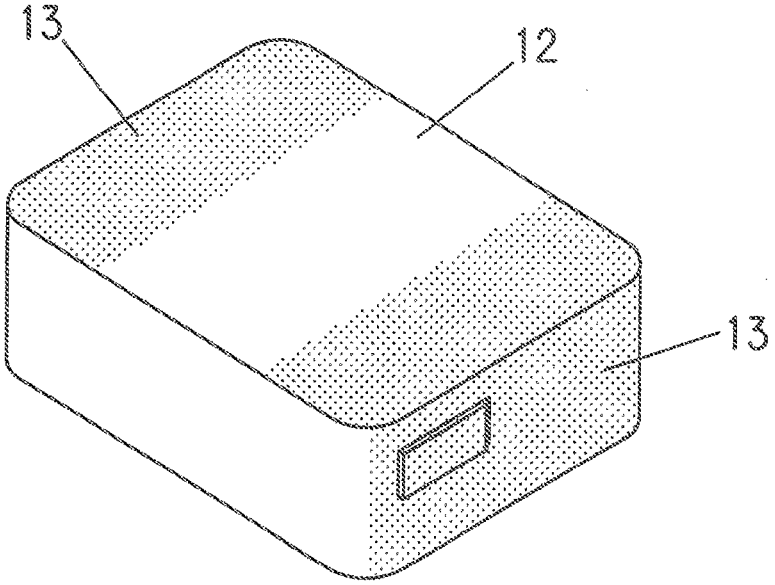
FIG. 7 is a perspective view of the core in a fabricated state according to the second embodiment of the present invention.
Figure 8:
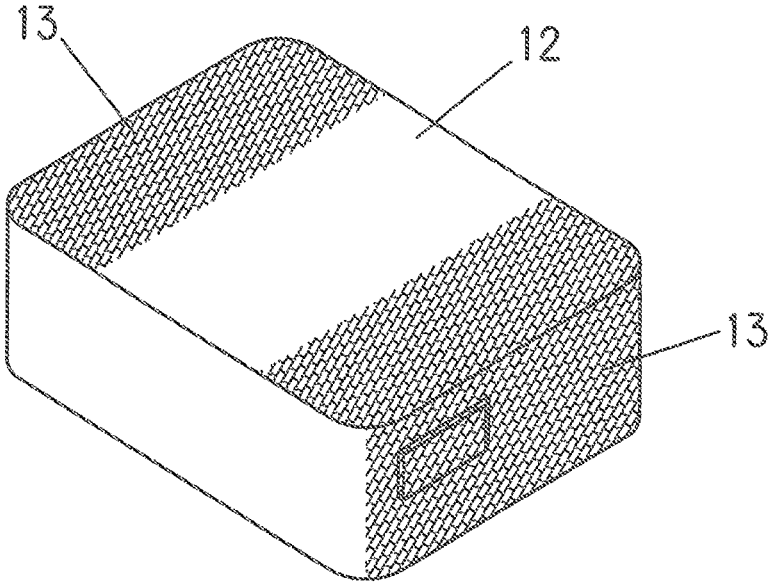
FIG. 8 is a perspective view of the core to which an electrically-conductive paste is applied, according to the first embodiment of the present invention.
Figure 9:
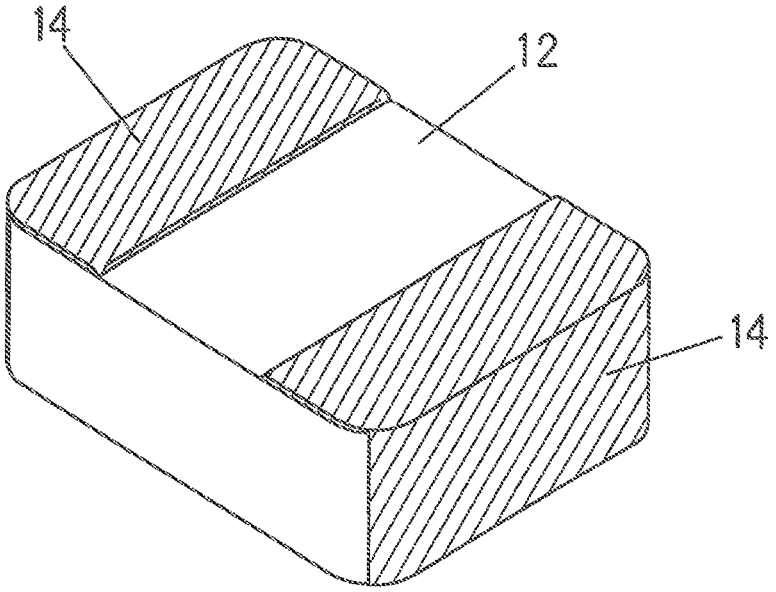
FIG. 9 is a perspective view of a surface-mount inductor produced by a method according to the second embodiment of the present invention.

With reference to FIGS. 6 to 9, a surface-mount inductor production method according to a second embodiment of the present invention will be described. FIG. 6 illustrates a perspective view of a core according to a second embodiment of the present invention. FIG. 7 illustrates a perspective view of the core in a fabricated state according to the second embodiment of the present invention. FIG. 8 illustrates a perspective view of the core to which an electrically-conductive paste is applied, according to the first embodiment of the present invention. FIG. 9 illustrates a perspective view of a surface-mount inductor produced by a method according to the second embodiment of the present invention.

Firstly, the electrically-conductive wire used in the first embodiment is wound in two-tiered outward spiral pattern in such a manner as to allow its opposite ends 11*a* to be positioned on an outermost periphery to form a coil 11. In this embodiment, the opposite ends 11*a* of the coil 11 are led out to be opposed to each other across the wound portion of the coil 11. Next, a sealant having the same composition as that used in the first embodiment is used to form a core 12 encapsulating the coil 11 as illustrated in FIG. 6 by a compressing molding process. In this process, each of the opposite ends 11*a* of the coil is allowed to be exposed on respective one of opposed lateral surfaces of the core 12.

Then, after removing the coating on a surface of the exposed opposite ends 11*a* by mechanical stripping, a treatment such as lasering, sandblasting or polishing is applied to the entire portion of the core 12 for allowing an external electrode to be formed thereon to remove components such as a resin component present on its surface to roughen the surface, thereby causing the surface of the entire portion of the core 12, for allowing the external electrode to be formed thereon, to be increased in roughness as compared to a surface therearound, as illustrated in FIG. 7. As a result, the surface of the entire portion of the core 12 for allowing the external electrode to be formed thereon is reduced in smoothness as compared to a surface therearound.

Next, as illustrated in FIG. 8, an electrically-conductive paste 13 used in the first embodiment is applied by a printing process in an L-shape on the portion of the core 2 for allowing the external electrode to be formed thereon. The core 12 on which the electrically-conductive paste 13 is applied is subjected to a heat treatment at 200° C., thereby to cause the core 12 and the thermosetting resin in the electrically-conductive paste to be cured. In this way, shrinkage stress arising from curing of the thermosetting resin is utilized to cause the metal particles dispersed in the resin of the electrically-conductive paste to come contact with each other or with an electrically-conductive wire to thereby obtain electrical conductivity. Further, the electrically-conductive paste 13 is fixed to the core 12, with the thermosetting resin and the metal particles in the electrically-conductive paste being entered into the concave portions on the surface of the core, formed in the roughened portion of the surface of the core 12.

Finally, the core 12 is subjected to plating to form an external electrode 14 on the surface of the electrically-conductive paste, thereby to obtain a surface-mount inductor comprising an L-shaped external electrode 14 as illustrated in FIG. 9.

(Third Embodiment)

Figure 10:
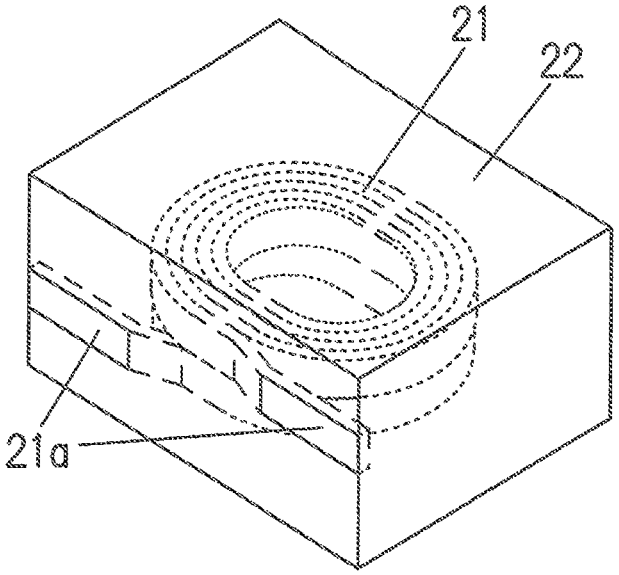
FIG. 10 is a perspective view of a core according to a third embodiment of the present invention.
Figure 11:
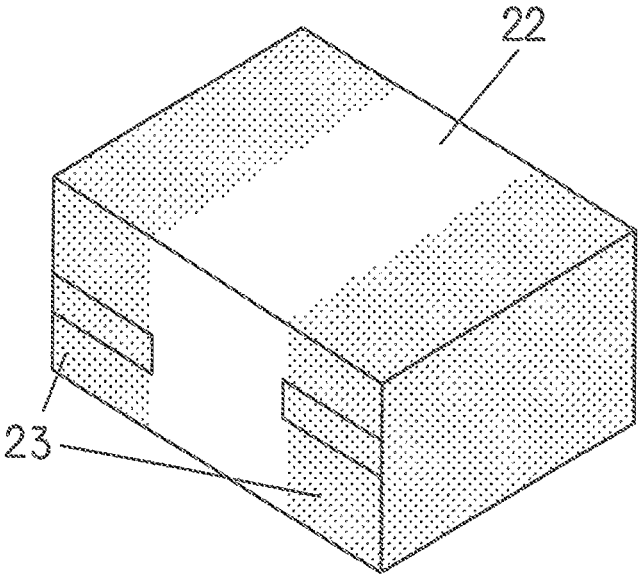
FIG. 11 is a perspective view of the core in a fabricated state according to the third embodiment of the present invention.
Figure 12:
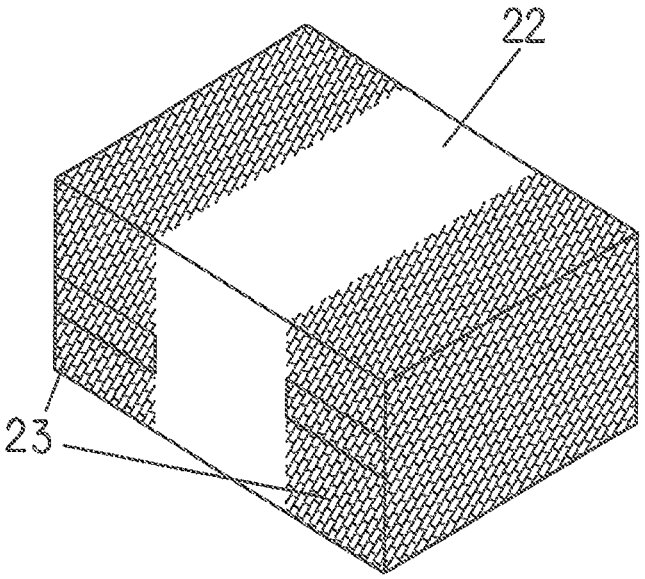
FIG. 12 is a perspective view of the core to which an electrically-conductive paste is applied, according to the third embodiment of the present invention.
Figure 13:
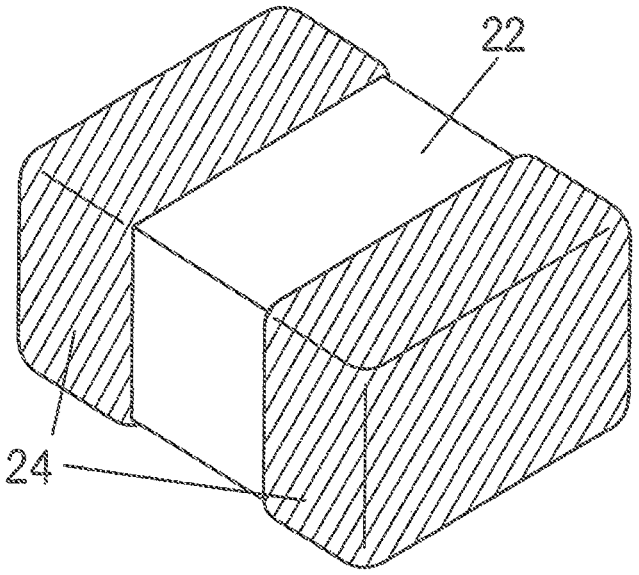
FIG. 13 is a perspective view of a surface-mount inductor produced by a method according to the third embodiment of the present invention.

With reference to FIGS. 10 to 13, a surface-mount inductor production method according to a third embodiment of the present invention will be described. FIG. 10 illustrates a perspective view of a core according to a third embodiment of the present invention. FIG. 11 illustrates a perspective view of the core in a fabricated state according to the third embodiment of the present invention. FIG. 12 illustrates a perspective view of the core to which an electrically-conductive paste is applied, according to the third embodiment of the present invention. FIG. 13 illustrates a perspective view of a surface-mount inductor produced by a method according to the third embodiment of the present invention.

Firstly, an electrically-conductive wire having a rectangular cross-section provided with a self-bonding coating is wound in two-tiered outward spiral pattern in such a manner as to allow its opposite ends 21*a* to be positioned on an outermost periphery to form a coil 21. Next, as a sealant, a type is used in which iron-based metal magnetic powders and an epoxy resin are mixed and granulated into powders to form a core 22 encapsulating the coil as illustrated in FIG. 10 by a compressing molding process. In this process, each of the opposite ends 21*a* of the coil is allowed to be exposed on a surface of the core 22.

Then, after removing the coating on a surface of the exposed opposite ends 21*a* by mechanical stripping, a treatment such as lasering, sandblasting or polishing is applied to the entire portion of the core 22 for allowing an external electrode to be formed thereon to remove components such as a resin component present on its surface to roughen the surface, thereby causing the surface of the entire portion of the core 22, for allowing the external electrode to be formed thereon, to be increased in roughness as compared to a surface therearound, as illustrated in FIG. 11. As a result, the surface of the entire portion of the core 22 for allowing the external electrode to be formed thereon is reduced in smoothness as compared to a surface therearound.

Next, as illustrated in FIG. 12, an electrically-conductive paste 23 is applied by a dip process on the portion of the core 22 for allowing the external electrode to be formed thereon. In this embodiment, as the electrically-conductive paste, a type is used in which Ag fine particles having a particle size of 10 nm or less and solvent such as organic solvent are mixed and pasted. Metals will have a lowered sintering temperature or melting temperature due to size effect when the particle size thereof is reduced below 100 nm. In particular, the sintering temperature or the melting temperature is significantly lowered with a size less than 10 nm. In this embodiment, the Ag fine particle is used. Alternatively, it is also possible to use Au or Cu. Further, the dip process is used in this embodiment as a process for applying the electrically-conductive paste. Alternatively, it is also possible to use other process such as a printing process or a potting process.

The core 22 on which the electrically-conductive paste 23 is applied is then subjected to a heat treatment at 200° C., thereby to sinter the Ag fine particles in the electrically-conductive paste 23 while curing the core 22. Since the Ag fine particle has a particle size of 10 nm or less, it can be easily sintered at this level of temperature. By causing the metal fine particles to be sintered, bonding between metals becomes stronger than the case of causing the metal particles to come contact with each other or with the electrically-conductive wire as in the first and second embodiments, so that electrical conduction with high connection reliability can be obtained between the coil and the electrically-conductive paste. Even when metal powders having a particle size of greater than 100 nm are mixed, the metal fine particles come into a sintered or molten state, so that it becomes possible to have bonding between metals stronger than the case of merely causing the metal fine particles to come contact with each other. Then, a heat treatment only at 250° C. or less is required in this process, so that damage to the core or the coating of the electrically-conductive wire is reduced. Further, the electrically-conductive paste is fixed to the core 22, with the Ag fine particles in the electrically-conductive paste 23 being entered into the concave portions on the surface of the core, formed in the roughened portion of the surface of the core 22. A content of a metal in the electrically-conductive paste fixed to the core 22 was in the range of 85 to 98%.

Finally, the core 22 is subjected to plating to form an external electrode 24 on the surface of the electrically-conductive paste, thereby to obtain a surface-mount inductor as illustrated in FIG. 13. The electrode formed by the plating may be formed by appropriately selecting one or more from materials such as Ni, Sn, Cu, Au and Pd.

(Fourth Embodiment)

Figure 14:
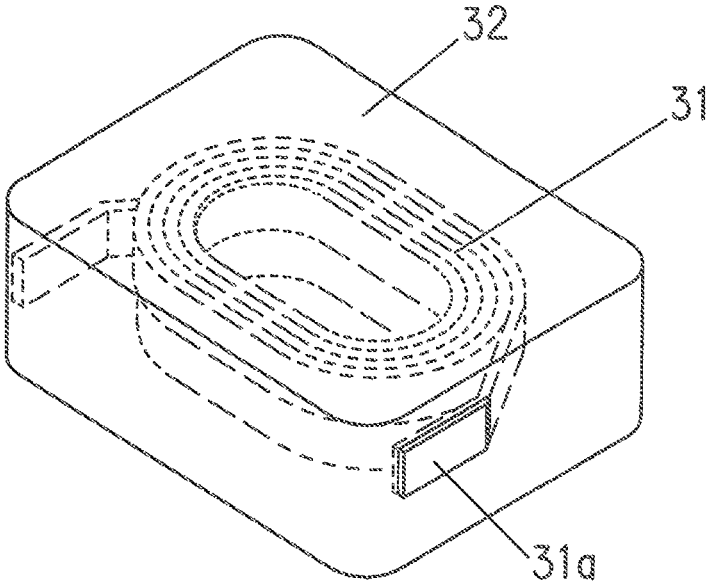
FIG. 14 is a perspective view of a core according to a fourth embodiment of the present invention.
Figure 15:
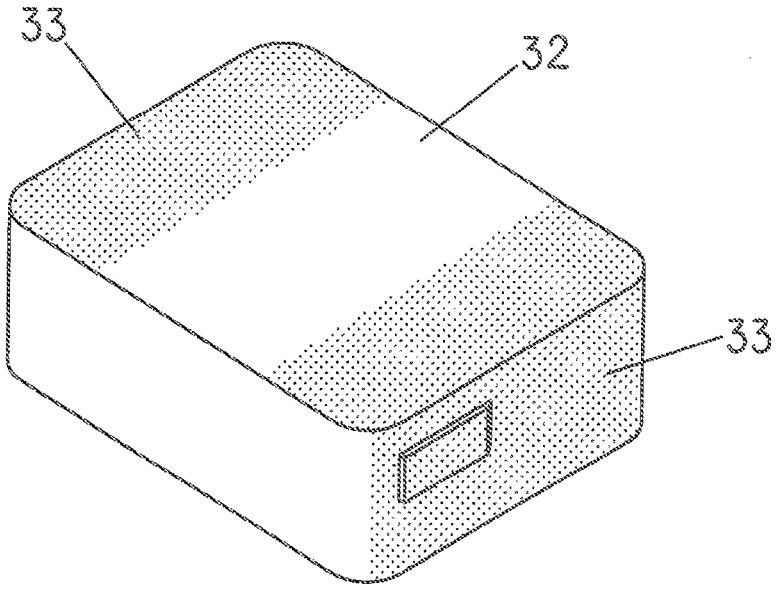
FIG. 15 is a perspective view of the core in a fabricated state according to the fourth embodiment of the present invention.
Figure 16:
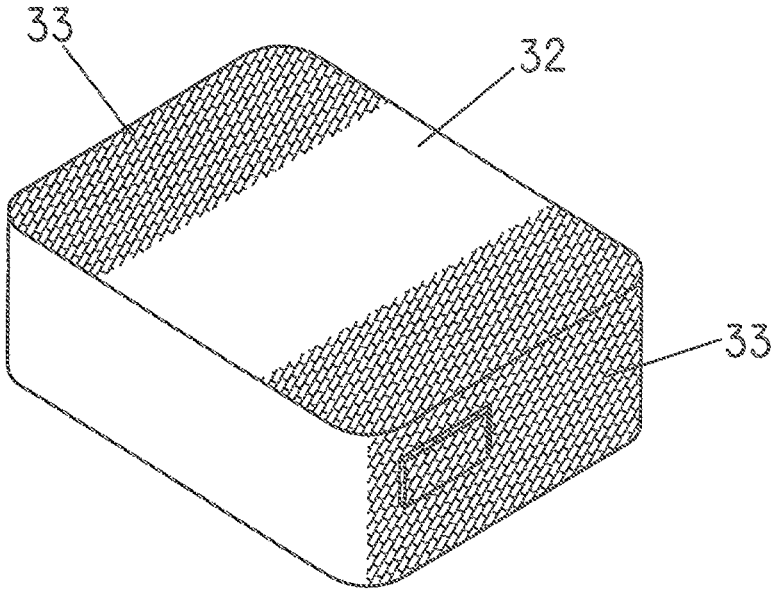
FIG. 16 is a perspective view of the core to which an electrically-conductive paste is applied, according to the fourth embodiment of the present invention.
Figure 17:
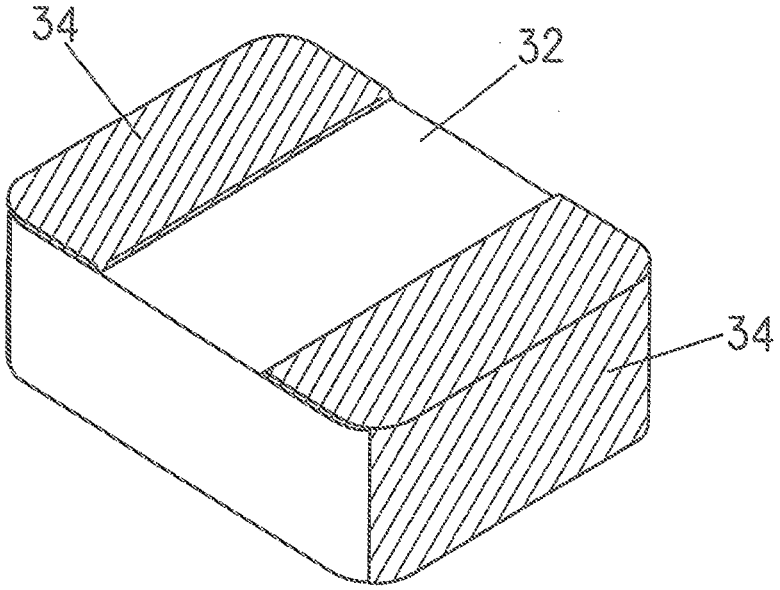
FIG. 17 is a perspective view of a surface-mount inductor produced by a method according to the fourth embodiment of the present invention.

With reference to FIGS. 14 to 17, a surface-mount inductor production method according to a fourth embodiment of the present invention will be described. FIG. 14 illustrates a perspective view of a core according to a fourth embodiment of the present invention. FIG. 15 illustrates a perspective view of the core in a fabricated state according to the fourth embodiment of the present invention. FIG. 16 illustrates a perspective view of the core to which an electrically-conductive paste is applied, according to the fourth embodiment of the present invention. FIG. 17 illustrates a perspective view of a surface-mount inductor produced by a method according to the fourth embodiment of the present invention.

Firstly, the electrically-conductive wire used in the third embodiment is wound in two-tiered outward spiral pattern in such a manner as to allow its opposite ends 31*a* to be positioned on an outermost periphery to form a coil 31. In this embodiment, the opposite ends 31*a* of the coil 31 are led out to be opposed to each other across the wound portion of the coil 31. Next, a sealant having the same composition as that used in the third embodiment is used to form a core 32 encapsulating the coil 31 as illustrated in FIG. 14 by a compressing molding process. In this process, each of the opposite ends 31*a* of the coil is allowed to be exposed on respective one of opposed lateral surfaces of the core 32.

Then, after removing the coating on a surface of the exposed opposite ends 31*a* by mechanical stripping, a treatment such as lasering, sandblasting or polishing is applied to the entire portion of the core 32 for allowing an external electrode to be formed thereon to remove components such as a resin component present on its surface to roughen the surface, thereby causing the surface of the entire portion of the core 32, for allowing the external electrode to be formed thereon, to be increased in roughness as compared to a surface therearound, as illustrated in FIG. 15. As a result, the surface of the entire portion of the core 32 for allowing the external electrode to be formed thereon is reduced in smoothness as compared to a surface therearound.

Next, as illustrated in FIG. 16, an electrically-conductive paste 33 is applied by a printing process in an L-shape on the portion of the core 32 for allowing the external electrode to be formed thereon. In this embodiment, as the electrically-conductive paste, a type is used in which Ag fine particles having a particle size of 10 nm or less, Ag particles having a particle size of 0.1 to 10 μm, and an epoxy resin are mixed and pasted. The electrically-conductive paste is prepared such that a ratio of the Ag particles having a particle size of 0.1 to 10 μm contained in the electrically-conductive paste to a sum of the Ag fine particles having a particle size of 10 nm or less and the Ag particles having a particle size of 0.1 to 10 μm is 30 wt %. Containing a 30 to 50 wt % of metal particles having a particle size of 0.1 to 10 μm provides an effect of reducing heat shrinkage at the time of thermal curing as compared to the case of only containing metal fine particles having a particle size of less than 100 nm. Further, the small amount of metal fine particles can also promise reduction in the material cost.

The core 32 on which the electrically-conductive paste 33 is applied is then subjected to a heat treatment at 200° C., thereby to sinter the Ag fine particles in the electrically-conductive paste 33 while curing the core 32, In this process, the electrically-conductive paste is fixed to the core 32, with the Ag fine particles in the electrically-conductive paste 32 being entered into the concave portions on the surface of the core, formed in the roughened portion of the surface of the core 32. A content of a metal in the electrically-conductive paste fixed to the core 22 was in the range of 85 to 98%.

Finally, the core 32 is subjected to plating to form an external electrode 34 on the surface of the electrically-conductive paste, thereby to obtain a surface-mount inductor as illustrated in FIG. 17.

In the above embodiments, as a sealant, a type is used in which iron-based metal magnetic powders as the magnetic powder and an epoxy resin as the resin are mixed. Alternatively, the magnetic powder for use in the sealant may be, for example, a ferritic magnetic powder or a magnetic powder that is subjected to surface modification such as insulation coating formation or surface oxidation. It is also possible to add an inorganic material such as a glass powder. Further, the resin for use in the sealant may be other thermosetting resin such as a polyimide resin or a phenol resin, or may be a thermoplastic resin such as a polyethylene resin or a polyamide resin.

In the above embodiments, as a coil, a type of being wound in two-tiered spiral pattern is used. Alternatively, the coil may be a type of being wound in edgewise winding or aligned winding pattern, or in a circular, rectangular, trapezoidal, semicircular shape, or combination thereof, in addition to an elliptic shape.

In the above embodiments, mechanical stripping is used as a method of stripping the coating on the surface of the ends of the coil. Alternatively, it is also possible to use other stripping methods. In addition, the coating on the ends may be stripped in advance prior to forming the core.

Figure 18:
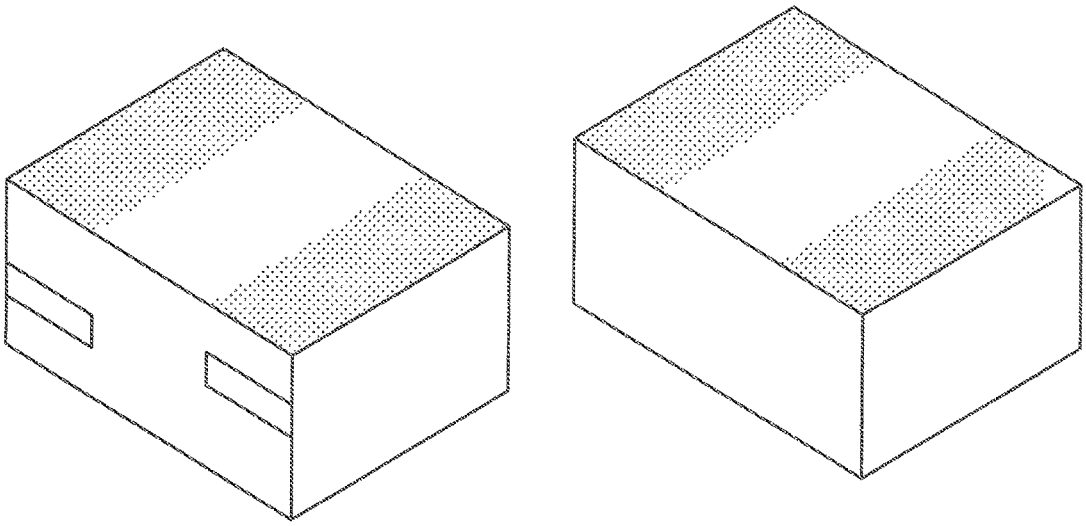
FIG. 18 is a perspective view of the core illustrating another fabricated state according to the present invention.
Figure 19:
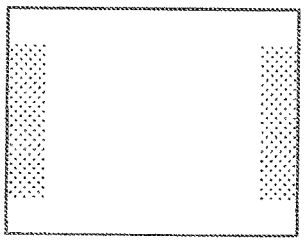
FIG. 19 is a bottom view of the core illustrating yet another fabricated state according to the present invention.

In the above embodiments, a treatment such as lasering, sandblasting or polishing is applied to the entire portion of the core for allowing an external electrode to be formed thereon to remove components such as a resin component present on its surface to roughen the surface, thereby causing the surface of the entire portion of the core, for allowing the external electrode to be formed thereon, to be reduced in smoothness as compared to a surface therearound. Alternatively, in the first and third embodiments, for example, it is also possible to cause a surface of a portion of only the upper and lower surfaces of the core, for allowing the external electrode to be formed thereon, to be reduced in smoothness as compared to a surface therearound, as illustrated in FIG. 18. Further, in the first to fourth embodiments, it is also possible to cause a surface of a part of a portion of the bottom surface of the core, for allowing an external electrode to be formed thereon, to be reduced in smoothness as compared to a surface therearound, as illustrated in FIG. 19. Furthermore, it is also possible to cause the entire bottom surface of the core to be reduced in smoothness as compared to other surfaces to thereby form an external electrode on the core.

EXPLANATION OF CODES

1, 11, 21, 31: coil (1*a*, 11*a*, 21*a*, 31*a*: end)
2, 12, 22, 32: core
3, 13, 23, 33: electrically-conductive paste
4, 14, 24, 34: external electrode

The invention claimed is:

1. A method of producing a surface-mount inductor having a coil encapsulated in a core, comprising the steps of:

winding an electrically-conductive wire to form the coil such that each of opposite ends of the wire is positioned on an outer periphery of the coil;

forming the core using a sealant primarily containing a metal magnetic powder and a resin to encapsulate the coil in the core in such a manner that a surface of each of opposite ends of the coil is exposed and extended on a surface of the core;

reducing smoothness of a surface of the core in an area of the core for forming an external electrode as compared to a surface around the area; and forming the external electrode on the core in such a manner as to be electrically conducted with the coil, by applying an electrically-conductive paste containing a thermosetting resin and metal particles on the area of the core for forming the external electrode, entering the electrically-conductive paste into concave portions on the surface of the core formed in a portion of the core where smoothness is reduced and curino the core and the electrically-conductive paste.

2. A method of producing a surface-mount inductor having a coil encapsulated in a core, comprising the steps of:

winding an electrically-conductive wire to form the coil such that each of opposite ends of the wire is positioned on an outer periphery of the coil;

forming the core using a sealant primarily containing a metal magnetic powder and a resin to encapsulate the coil in the core in such a manner that a surface of each of opposite ends of the coil is exposed and extended on a surface of the core:

reducing smoothness of a surface of the core in an area of the core for forming an external electrode as compared to a surface around the area; and forming the external electrode on the surface of the core in such a manner as to be electrically conducted with the coil, by applying an electrically-conductive paste containing a thermosetting resin and metal fine particles having a sintering temperature of 250° C. or less on the area of the core for forming, the external electrode, entering the electrically-conductive paste into concave portions of the core formed in a portion of the core where smoothness is reduced, and subjecting the core to a heat treatment to sinter the metal fine particles.

3. The method as defined in claim 2, wherein the resin of the sealant comprises a thermosetting resin, and wherein an underlying electrode constituting the external electrode is formed by sintering the metal fine particles while curing the core, through the heat treatment.

4. The method as defined in claim 3, wherein the metal fine particles contain at least one selected from the group consisting of Ag, Au and Cu, and have a particle size of less than 100 nm.

5. The method as defined in claim 4, wherein the electrically-conductive paste further contains metal particles having a particle size of 0.1 to 10 μm, wherein a ratio of the metal particle to a sum of the metal fine particle and the metal particle contained in the electrically-conductive paste is in the range of 30 to 50 wt%.

6. The method as defined in claim 5, wherein a content of a metal in the external electrode is in the range of 85 to 98%.

7. The method as defined in claim 3, wherein a content of a metal in the external electrode is in the range of 85 to 98%.

8. The method as defined in claim 4, wherein a content of a metal in the external electrode is in the range of 85 to 98%.

9. The method as defined in claim 2, wherein the metal fine particles contain at least one selected from the group consisting of Ag, Au and Cu, and have a particle size of less than 100 nm.

10. The method as defined in claim 9, wherein the electrically-conductive paste further contains metal particles having a particle size of 0.1 to 10 μm, wherein a ratio of the metal particle to a sum of the metal fine particle and the metal particle contained in the electrically-conductive paste is in the range of 30 to 50 wt%.

11. The method as defined in claim 10, wherein a content of a metal in the external electrode is in the range of 85 to 98%.

12. The method as defined in claim 9, wherein a content of a metal in the external electrode is in the range of 85 to 98%.

13. The method as defined in claim 2, wherein a content of a metal in the extrnal electrode is in the range of 85 to 98%.

* * * * *